United States Patent [19]

Rampe

[11] Patent Number: 4,520,598

[45] Date of Patent: Jun. 4, 1985

[54] BOWL-TYPE VIBRATORY FINISHING MACHINE

[75] Inventor: John F. Rampe, Bratenahl, Ohio

[73] Assignee: Jepmar, Fairport Harbor, Ohio

[21] Appl. No.: 444,362

[22] Filed: Nov. 29, 1982

Related U.S. Application Data

[63] Continuation-in-part of Ser. No. 406,976, Aug. 13, 1982, abandoned.

[51] Int. Cl.[3] ..... B24B 31/06

[52] U.S. Cl. ..... 51/163.2

[58] Field of Search ..... 51/163.1, 163.2, 17; 241/175; 366/128, 114, 110, 111; 384/203, 206

[56] References Cited

U.S. PATENT DOCUMENTS 4,095,856 6/1978 Markovitz ..... 384/206

4,428,161 1/1984 Walther et al. ..... 51/163.2

*Primary Examiner*—Harold D. Whitehead

*Attorney, Agent, or Firm*—David A. Burge

[57] ABSTRACT

A bowl-type vibratory finishing machine is disclosed which employs an extremely simple yet highly effective arrangement of components enabling a relatively low-energy-input drive system to efficiently impart an extraordinarily aggressive finishing action to a mixture of workpieces and finishing media contained within an annular, trough-like finishing chamber defined by a movably supported bowl. The finishing chamber extends substantially horizontally about a substantially vertical center axis. An eccentrically weighted drive shaft extends along the center axis and is journaled by bearings which are connected to the bowl so that, when the drive shaft is rotated, vibrations generated by the unbalanced nature of the drive shaft are transmitted to the bowl and cause the bowl to vibrate generally about a nodal point located along the central axis. A feature of the invention lies in the proper selection of a nodal point location which maximizes the efficiency of the vibratory impulses that are imparted to the contents of the bowl, and which permits a truly aggressive finishing action to be effected utilizing a relatively low-energy-input drive. A further feature of the invention lies in the provision of a relatively flexible drive shaft restraint which assists in assuring that the bowl tends to gyrate substantially about a selected nodal point location so that the desired type of aggressive finishing action is achieved with efficiency of operation. Still another feature lies in the simplification which the present invention brings to the art of designing bowl-type vibratory finishing machines.

29 Claims, 4 Drawing Figures

BOWL-TYPE VIBRATORY FINISHING MACHINE

CROSS-REFERENCE TO RELATED APPLICATION

The present application is a continuation-in-part of application Ser. No. 406,976 filed Aug. 13, 1982, now abandoned in favor of the present case.

BACKGROUND OF THE INVENTION

1. Field of the Invention

The present invention relates to a bowl-type vibratory finishing machine employing an extremely simple yet highly effective arrangement of components which enable a relatively low-energy-input drive system to efficiently impart an extraordinarily aggressive finishing action to a mixture of workpieces and finishing media contained within the finishing chamber of a movably supported bowl.

2. Prior Art

Two basic types of eccentric-driven vibratory finishing machines are in common use. One type employs an elongate receptacle which defines an elongate, trough-like finishing chamber extending in a substantially horizontal plane, and which is vibrated by rotating one or more eccentrically-weighted drive shafts about one or more substantially horizontal axes extending along the receptacle. This first type of machine is known in the art as a "tub-type machine" or simply a "tub machine," and its receptacle is commonly called a "tub." Another type uses a substantially toroidal-shaped receptacle which defines an annular, trough-like finishing chamber extending in a generally horizontal plane, and which is vibrated by rotating an eccentrically-weighted drive shaft about a substantially vertical "center axis" located centrally of the receptacle when the receptacle is at rest. This latter type of machine is known in the art as a "bowl-type machine" or simply a "bowl machine," and its receptacle is commonly called a "bowl." The present invention relates to bowl machines.

During the operation of a bowl machine, the bowl vibrates in a complex gyratory type of motion which subjects the bowl's contents to impulses that include components which extend axially, radially and circumferentially with respect to the center axis of the machine. The impulses are oriented and timed to effect both circumferential precession and rotary churning to effect a finishing action. Surface finishing operations such as deburring, burnishing, descaling, cleaning and the like may be performed depending on the type of vibratory action which is provided, the type of finishing media employed, and other factors.

An objective in designing a bowl machine is to provide a simple and relatively inexpensive, yet reliable system which will enable a truly aggressive finishing action to be imparted to the contents of the bowl. A challenge facing the industry has been to provide an efficient bowl machine design which is capable of generating the type of large amplitude vibrations needed to provide an aggressive finishing action, while minimizing the use of inordinately massive and costly components. An arrangement of bowl machine components which permits a truly aggressive finishing action to be achieved with genuine efficiency using a low-energy-input drive system has long eluded the experts of this industry.

Those skilled in the art have maintained different and conflicting theories on where the nodal point about which the bowl gyrates optimally should be located along the center axis. Some maintain that the nodal point should be located within or near a horizontal plane which includes the center of gravity of the bowl's contents in an effort to minimize horizontal impulse components imparted to the bowl's contents and to maximize vertical impulse components. Others maintain that a nodal point location slightly below the bottom of the bowl is desirable since it gives something of a mix of vertical, horizontal and circumferential impulse components. Still others advocate higher and lower nodal point locations. A practical problem not well addressed by these conflicting proposals is that, in reality, with most bowl machine designs there is a tendency for the location of the nodal point about which the bowl gyrates to move about quite extensively (i.e., to shift about in a very undesirable manner) during start-up and shutdown of the machine, and during operation in response to changes in the loading of the bowl. If the location of the nodal point is displaced to any significant degree from the nodal point location for which the machine was designed, the machine operates inefficiently, if at all, and subjects its drive and suspension system components to needless wear.

Those skilled in the art have similarly advanced difference and conflicting theories regarding design approaches which should be followed to determine the structural arrangement of such components as the bowl and its suspension system, the locations and types of eccentric weights which are carried on the drive shaft to vibrate the bowl, the type of power-operated drive which should be used to rotate the eccentric drive shaft, and the character and location of the connection made between the power-operated drive and the drive shaft.

Considerations such as nodal point location, the number, location and arrangement of eccentrics, and others of the foregoing design factors are rendered more complex inasmuch as they cannot be analyzed and treated independently; these important considerations are interrelated and interact to influence and determine such other factors as:

(a) the complexity and cost of manufacture of the machine;
(b) the ease with which the machine can be serviced and such limited-life parts as bearings replaced;
(c) the longevity of service which can be expected from the machine;
(d) the sensitivity of the machine to different bowl loadings, i.e. whether it can handle a wide range of large and small, as well as heavy and light loads; and,
(e) the type of vibratory movement which is imparted to the bowl, which, in turn, determines such things as:
  (i) the type of churning movement which will be executed by a mixture of media and workpieces in the bowl;
  (ii) the direction and rate of precession of the mixture; and,
  (iii) the efficiency and aggressiveness of the resulting finishing action in terms of the amount of energy which must be expended and the time required to execute a desired finishing operation.

With so many interrelated and interacting variables to consider, it is no wonder that much of the progress which has been made in improving bowl machine designs has resulted not from the promulgation of desk-side calculations, but rather through the building, testing, rebuilding and continued modification of prototype machinery. Once a machine has been rendered operable and proven through testing, the machine design has then been made the subject of attempts to understand and divine plausible theories which may explain the mysteries of its operation. Stated in another way, what has long eluded those skilled in the art is a simple and straightforward design approach which can be implemented with ease to provide a lean and relatively inexpensive bowl-type vibratory finishing machine of desired capacity having the capability to efficiently generate a highly aggressive finishing action.

3. Reference to Relevant Patents

The vibratory finishing machine art is replete with complex and conflicting theories and proposals which are intended to facilitate the design of a bowl-type vibratory finishing machine (1) that is simple and straightforward in construction, (2) that is easy to manufacture, install, use, maintain and repair, and (3) which incorporates the elusive capability to efficiently impart a truly aggressive finishing action utilizing a low-energy-input drive system. The disclosures of the following patents are incorporated herein by reference inasmuch as their introductory discussions present, by way of examples, some of the conflicting theories and proposals which typify the very genuine frustrations which have long stood as stumbling blocks to those skilled in the art:

BOWL-TYPE VIBRATORY FINISHING MACHINE, U.S. Pat. No. 4,301,625 issued Nov. 24, 1981 as a continuation-in-part of UNLOADING SYSTEM FOR BOWL-TYPE VIBRATORY FINISHING MACHINE, U.S. Pat. No. 4,184,290 issued Jan. 22, 1980 to John F. Rampe as a continuation-in-part of BOWL-TYPE VIBRATORY FINISHING MACHINE, U.S. Pat. No. 4,091,575 issued May 30, 1978 to John F. Rampe; and, SUSPENSION SYSTEM FOR BOWL-TYPE VIBRATORY FINISHING MACHINE, U.S. Pat. No. 4,090,332 issued May 23, 1978 to John F. Rampe as a continuation-in-part of BOWL-TYPE VIBRATORY FINISHING MACHINE, U.S. Pat. No. 4,091,575 issued May 30, 1978 to John F. Rampe. The disclosures of the foregoing patents are also incorporated for their teachings of bowl machine charging and discharging devices as well as other bowl machine features which, although they form no part of the present invention, are nonetheless usable with bowl machines that embody features of the present invention.

SUMMARY OF THE INVENTION

The present invention overcomes the foregoing and other drawbacks by providing a bowl-type vibratory finishing machine which employs a simple, yet highly effective arrangement of components that enables a low-energy-input drive system to efficiently impart an extraordinarily aggressive finishing action to a mixture of workpieces and finishing media contained within a movably supported bowl. Moreover, the present invention provides a simple and straightforward design approach which can be implemented with ease to provide a bowl machine of desired capacity which will efficiently impart a truly aggressive finishing action to workpieces and media contained within its finishing chamber.

A bowl-type vibratory finishing machine incorporating the preferred practice of the present invention includes a bowl which is movably supported on a base. The bowl defines a generally annular, trough-like finishing chamber which extends in a substantially horizontal plane about a substantially vertical center axis. An eccentrically-weighted drive shaft extends along the center axis. The drive shaft is journaled by bearings which are connected to the bowl so that, when the drive shaft is rotated, the vibrations generated by its unbalanced character are transmitted to the bowl, thereby causing the bowl to vibrate generally about a nodal point located along the center axis. A drive motor is carried by the base and is drivingly connected to the drive shaft.

A feature of the invention lies in the proper selection of a nodal point location which maximizes the efficiency of the vibratory impulses which are imparted to the contents of the bowl, and which permits a truly aggressive finishing action to be effected utilizing a relatively low-energy-input drive. A further feature of the invention lies in the provision of a relatively flexible drive shaft restraint which assists in constraining movements of the bowl to vibratory and gyratory movements generally about the selected nodal point location. Drive shaft movement is permitted only to a limited degree in the vicinity of the nodal point so that bowl movements are properly constrained, whereby the desired type of aggressive finishing action is achieved with efficiency of operation.

Still another feature lies in the simplification which the present invention brings to the design of bowl-type vibratory finishing machines. Once a decision has been made on the dimensions of the bowl needed to provide a finishing chamber of the desired capacity, the design of the remainder of the machine is effected by using a simple formula to determine the proper location of the nodal point relative to the finishing chamber, by providing the drive shaft with a flexible restraint which will tend to constrain movements of the bowl to movements generally about the selected nodal point location, and by designing the remaining structural components to efficiently compliment the desired amplitude and frequency of vibratory movement of the bowl about the properly selected nodal point.

DESCRIPTION OF THE DRAWINGS

The foregoing and other features and a fuller understanding of the invention described and claimed in the present application may be had by referring to the following description and claims taken in conjunction with the accompanying drawings, wherein:

DESCRIPTION OF THE PREFERRED EMBODIMENT

Figure 1:
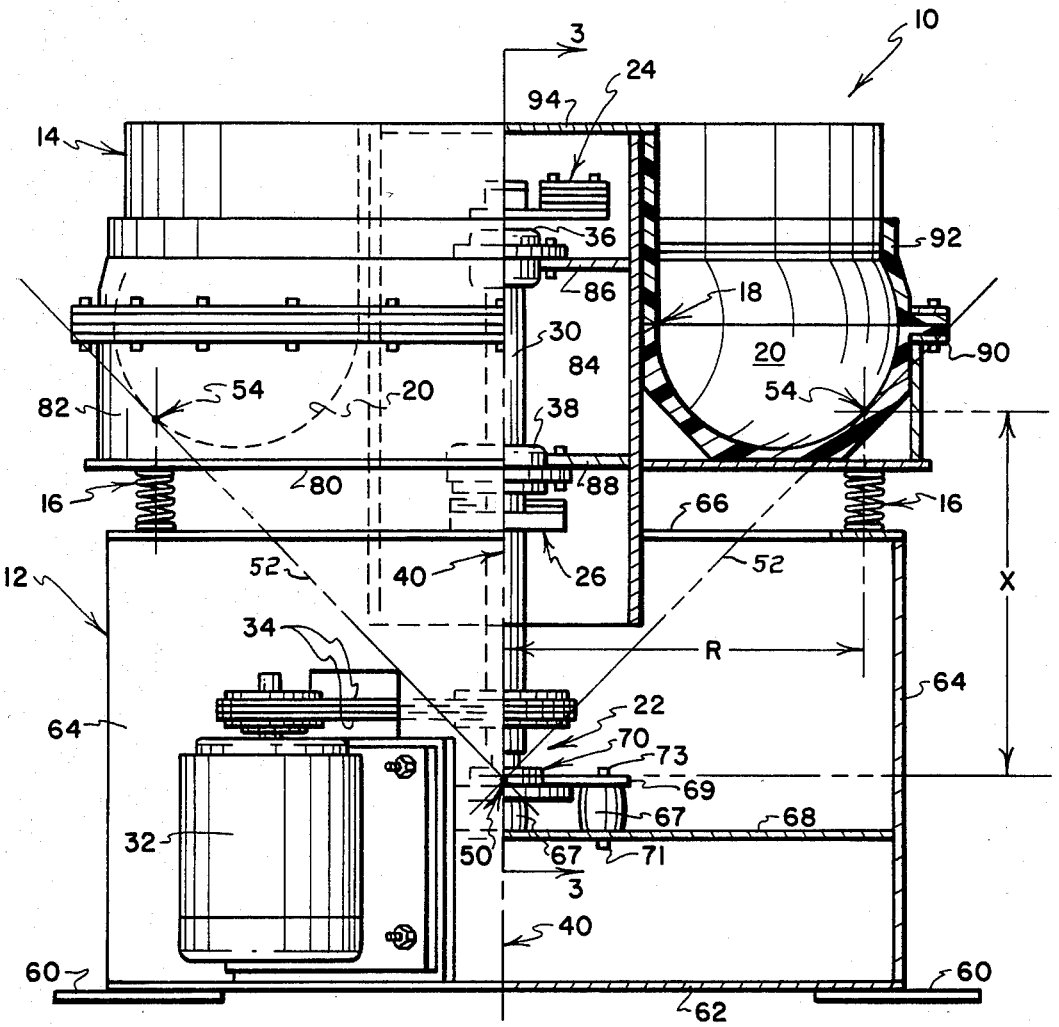
FIG. 1 is a side elevational view of one embodiment of a bowl-type vibratory finishing machine incorporating features of the present invention, the view having portions broken away and shown in cross-section.

Referring to FIG. 1, an open-top, bowl-type vibratory finishing machine incorporating features of the present invention is indicated generally by the numeral 10. The machine 10 includes a base structure 12 and a bowl structure 14. Resilient mounts in the form of compression coil springs 16 interconnect the structures 12, 14 to movably support the bowl 14 atop the base 12. A replaceable resilient liner assembly 18 forms a part of the bowl structure 14 and defines an annular finishing chamber 20 for receiving a mixture of finishing media and workpieces to be finished.

A drive system for imparting vibratory movements to the bowl 14 is indicated generally by the numeral 22. The drive system 22 includes upper and lower eccentric weight assemblies 24, 26 supported at spaced locations along a rotatable central drive shaft 30, a motor 32, and belts 34 which drivingly interconnect the motor 32 with the eccentrically weighted. Upper and lower bearing blocks 36, 38 journal the drive shaft 30 and are connected to the bowl 14 such that, when the drive shaft 30 is rotated, the vibrations it generates are transmitted to the bowl 14 to impart a finishing action to contents carried within the finishing chamber 20.

The machine 10 has a "center axis," indicated generally by the numeral 40. The center axis 40 is an imaginary vertical line defined by the axis of the eccentric drive shaft 30 when the machine 10 is at rest. The center axis 40 extends substantially coaxially of the annular finishing chamber 20.

During operation of the machine 10, the bowl 14 gyrates in response to vibrations generated by rotation of the eccentric drive shaft 30. The bowl prescribes a movement which generally centers about a node or nodal point 50. The nodal point 50 is located at the juncture of the center axis 40 and the tip of an imaginary inverted cone, opposed side surfaces of which are indicated in FIG. 1 by lines 52. The cone 52 has as its center axis of the machine's center axis 40, i.e., the center axis 40 bisects the included angle between the lines 52. The cone 52 extends upwardly from the nodal point 50 to locations wherein it substantially tangentially intersects lower rounded locations 54 of the base of the finishing chamber 20. The locus of the locations 54 wherein the cone 52 tangentially intersects the finishing chamber 20 is an imaginary circle which extends in a substantially horizontal plane at a location spaced vertically above the nodal point 50 by a distance indicated by a dimension "X." The locations 54 which define this imaginary circle are spaced axially from the center axis 40 by a dimension "R."

The base structure 12 has a welded framework including feet 60, a bottom wall 62, side wall members 64, a top wall 66, and a mounting plate 68. A plurality of elastomeric mounts 67 are arranged at substantially equally-spaced locations about the circumference of an imaginary circle which has as its center a point on the center axis 40. The mounts 67 have their lower ends secured as by threaded fasteners 71 to the mounting plate 68, and have their upper ends secured as by threaded fasteners 73 to an annular bearing-mounting plate 69. The mounts 67 are commercially available from a number of sources, an example being mount model number J3424-143 sold by Lord Corporation of Erie, PA 16512.

A spherical bearing 70 is carried by the plate 69 at the location of the nodal point 50. The spherical bearing 70 journals the eccentric drive shaft 30 and provides essentially a ball-joint type of connection between the drive shaft 30 and the base 12. This connection tends to constrain movements of the bowl 14 relative to the base 12 to movements generally about the nodal point 50. The resilient mounting of the plate 69 by the elastomeric mounts 67 permits the bearing 70 to gyrate radially with respect to the center axis 40 to a limited degree during operation of the machine 10. The spherical bearing 70 slidably receives the drive shaft 30 so that the drive shaft 30 can move axially relative to the bearing 70. By this arrangement, the bearing 70 in no way interferes with the operation of the springs 16 in supporting the bowl 14 for movement relative to the base 12 and the weight of the bowl 14 and/or its contents are prohibited from being transmitted not only to the bearing 70 but also to the elastomeric mounts 67. Thus, movements of the bowl 14 during operation of the machine 10 tend to load the mounts 67 in directions extending radial to the center axis 40 (i.e., in shear) as opposed to axially (i.e., in compression or tension).

The bowl structure 14 has a welded framework including a bottom wall 80, a side wall 82, an upstanding center tube 84, and a pair of bearing mounting plates 86, 88. The bearing mounting plates 86, 88 carry the bearings 36, 38, respectively. The bottom wall 80 is of annular configuration and is perimetrically welded to the side wall 82. The side wall 82 is of cylindrical configuration, extends upwardly from the bottom wall 80, and has a laterally extending rim 90 welded to its upper periphery. An upwardly-extending extension 92 of the side wall 82 is bolted to the rim 90. The center tube 84 extends centrally through and is welded to the bottom wall 80. A cover plate 94 closes the upper end of the center tube 84.

A plurality of compression coil springs 16 are employed to movably support the bowl structure 14 atop the base structure 12. Each of the springs 16 has its opposed ends secured to the top wall 66 and to the bottom wall 80. The springs 16 perform optimally when they are located at equal radial distances from the center axis 40, as is indicated in FIG. 1 by the dimension "R." The springs 16 are positioned at uniformly spaced locations about the circumference of an imaginary circle having as its center a point on the center axis 40, and having as its radius the distance "R."

Figure 4:
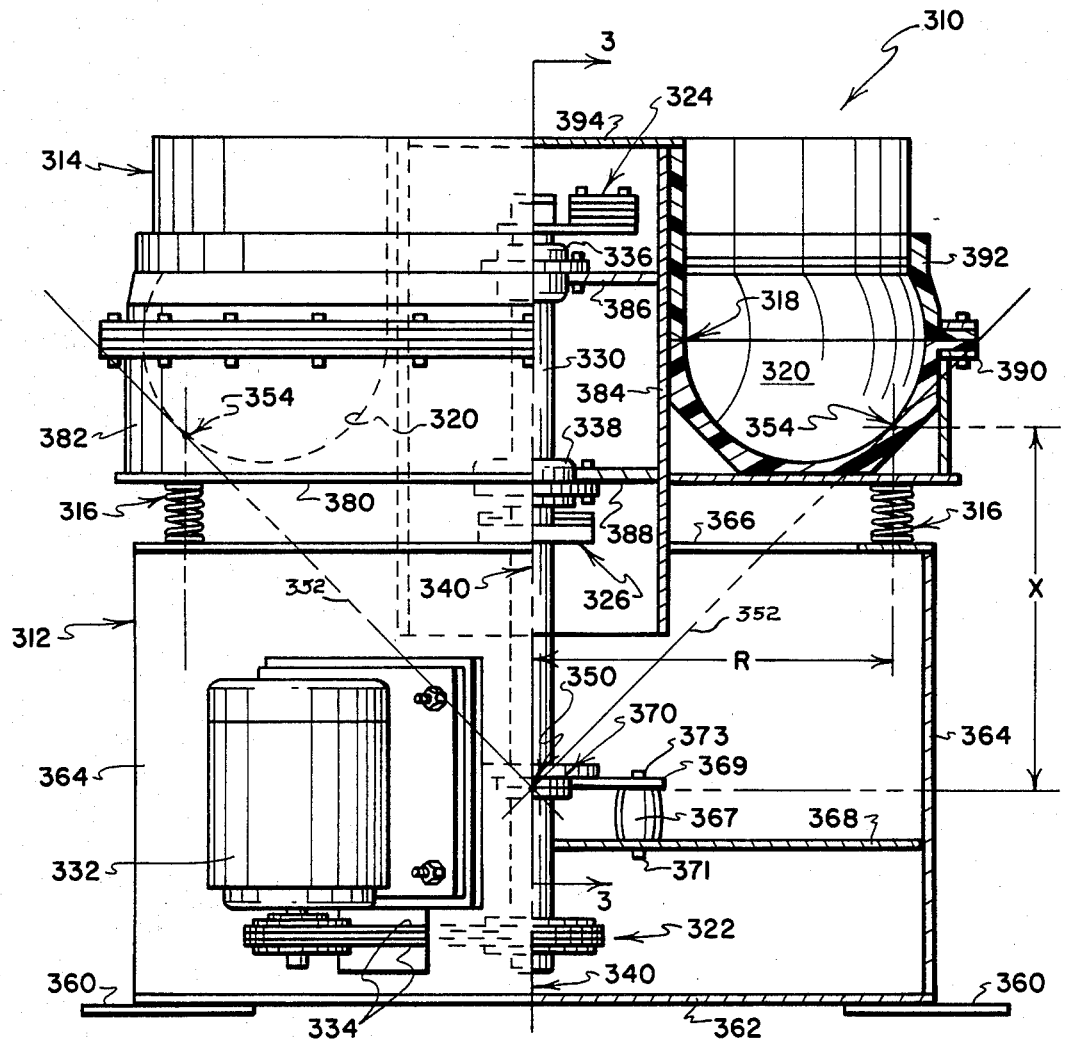

Referring to FIG. 4, an alternate form of open-top bowl machine, which is very similar in construction to the open-top machine 10, is indicated generally by the numeral 310. The machine 310 includes a base structure 312 and a bowl structure 314. Resilient mounts in the form of compression coil springs 316 interconnect the structures 312, 314 to movably support the bowl 314 atop the base 312. A replaceable resilient liner assembly 318 forms a part of the bowl structure 314 and defines an annular finishing chamber 320 for receiving a mixture of finishing media and workpieces to be finished.

A drive system for imparting vibratory movements to the bowl 314 is indicated generally by the numeral 322. The drive system 322 includes upper and lower eccentric weight assemblies 324, 326 supported at spaced locations along a rotatable central drive shaft 330, a motor 332, and belts 334 which drivingly interconnect the motor 332 with the eccentric drive shaft 330. Upper and lower bearing blocks 336, 338 journal the eccentric drive shaft 330 and are connected to the bowl 314 such that, when the eccentric drive shaft 330 is rotated, the vibrations it generates are transmitted to the bowl 314 to impart a finishing action to contents carried within the finishing chamber 320.

The machine 310 has a "center axis," indicated generally by the numeral 340. The center axis 340 is an imaginary vertical line defined by the axis of the eccentric drive shaft 330 when the machine 310 is at rest. The center axis 340 extends substantially coaxially of the annular finishing chamber 320.

During operation of the machine 310, the bowl 314 gyrates in response to vibrations generated by rotation of the eccentric drive shaft 330. The bowl prescribes a movement which generally centers about a node or nodal point 350. The nodal point 350 is located at the juncture of the center axis 340 and the tip of an imaginary inverted cone, opposed side surfaces of which are indicated in FIG. 4 by lines 352. The cone 352 has as its center axis the machine's center axis 340, i.e., the center axis 340 bisects the included angle between the lines 352. The cone 352 extends upwardly from the nodal point 350 to locations wherein it substantially tangentially intersects lower rounded locations 354 of the base of the finishing chamber 320. The locus of the locations 354 wherein the cone 352 tangentially intersects the finishing chamber 320 is an imaginary circle which extends in a substantially horizontal plane at a location spaced vertically above the nodal point 350 by a distance indicated by a dimension "X." The locations 354 which define this imaginary circle are spaced axially from the center axis 340 by a dimension "R."

The base structure 312 has a welded framework including feet 360, a bottom wall 362, side wall members 364, a top wall 366, and a mounting plate 368. A plurality of elastomeric mounts 367 are arranged at substantially equally-spaced locations about the circumference of an imaginary circle which has as its center a point on the center axis 340. The mounts 367 have their upper ends secured as by threaded fasteners 371 to the mounting plate 368, and have their lower ends secured as by threaded fasteners 373 to an annular bearing-mounting plate 369. The mounts 367 are commercially available from a number of sources, an example being mount model number J3424-143 sold by Load Corporation of Erie, PA 16512.

A spherical bearing 370 is carried by the plate 369 at the location of the nodal point 350. The spherical bearing 370 journals the eccentric drive shaft 330 and provides essentially a ball-joint type of connection between the drive shaft 330 and the base 312. This connection tends to constrain movements of the bowl 314 relative to the base 312 to movements generally about the nodal point 350. The resilient mounting of the plate 369 by the elastomeric mounts 367 permits the bearing 370 to gyrate radially with respect to the center axis 340 to a limited degree during operation of the machine 310. The spherical bearing 370 slidably receives the drive shaft 330 so that the drive shaft 330 can move axially relative to the bearing 370. By this arrangement, the bearing 370 in no way interferes with the operation of the springs 316 in supporting the bowl 314 for movement relative to the base 312, and the weight of the bowl 314 and/or its contents are prohibited from being transmitted not only to the bearing 370 but also to the elastomeric mounts 367. Thus, movements of the bowl 314 during operation of the machine 310 tend to load the mounts 367 in directions extending radial to the central axis 340 (i.e., in shear) as opposed to axially (i.e., in compression or tension).

The bowl structure 314 has a welded framework including a bottom wall 380, a side wall 382, an upstanding center tube 384, and a pair of bearing mounting plates 386, 388. The bearing mounting plates 386, 388 carry the bearings 336, 338, respectively. The bottom wall 380 is of annular configuration and is perimetrically welded to the side wall 382. The side wall 382 is of cylindrical configuration, extends upwardly from the bottom wall 380, and has a laterally extending rim 390 welded to its upper periphery. An upwardly-extending extension 392 of the side wall 382 is bolted to the rim 390. The center tube 384 extends centrally through and is welded to the bottom wall 380. A cover plate 394 closes the upper end of the center tube 384.

A plurality of compression coil springs 316 are employed to movably support the bowl structure 314 atop the base structure 312. Each of the springs 316 has its opposed ends secured to the top wall 366 and to the bottom wall 380. The springs 316 perform optimally when they are located at equal radial distances from the center axis 340, as is indicated in FIG. 1 by the dimension "R." The springs 316 are positioned at uniformly spaced locations about the circumference of an imaginary circle having as its center a point on the center axis 340, and having as its radius the distance "R."

The machines 10, 310 of FIGS. 1 and 4, respectively, differ only in their mountings of the motors 32, 332, and in their locations of pulleys and belts, 334 which form the drive systems 22, 322. While the connection made by a bowl machine drive system to the machine's drive shaft is desirably quite close to the machine's nodal point, as is the situation with the machine design 10 of FIG. 1, in applications where drive shaft movement is not excessive during machine operation, a drive system connection that is more spaced from a machine's nodal point can be employed, as is illustrated in the machine design 310 of FIG. 4.

Figure 2:
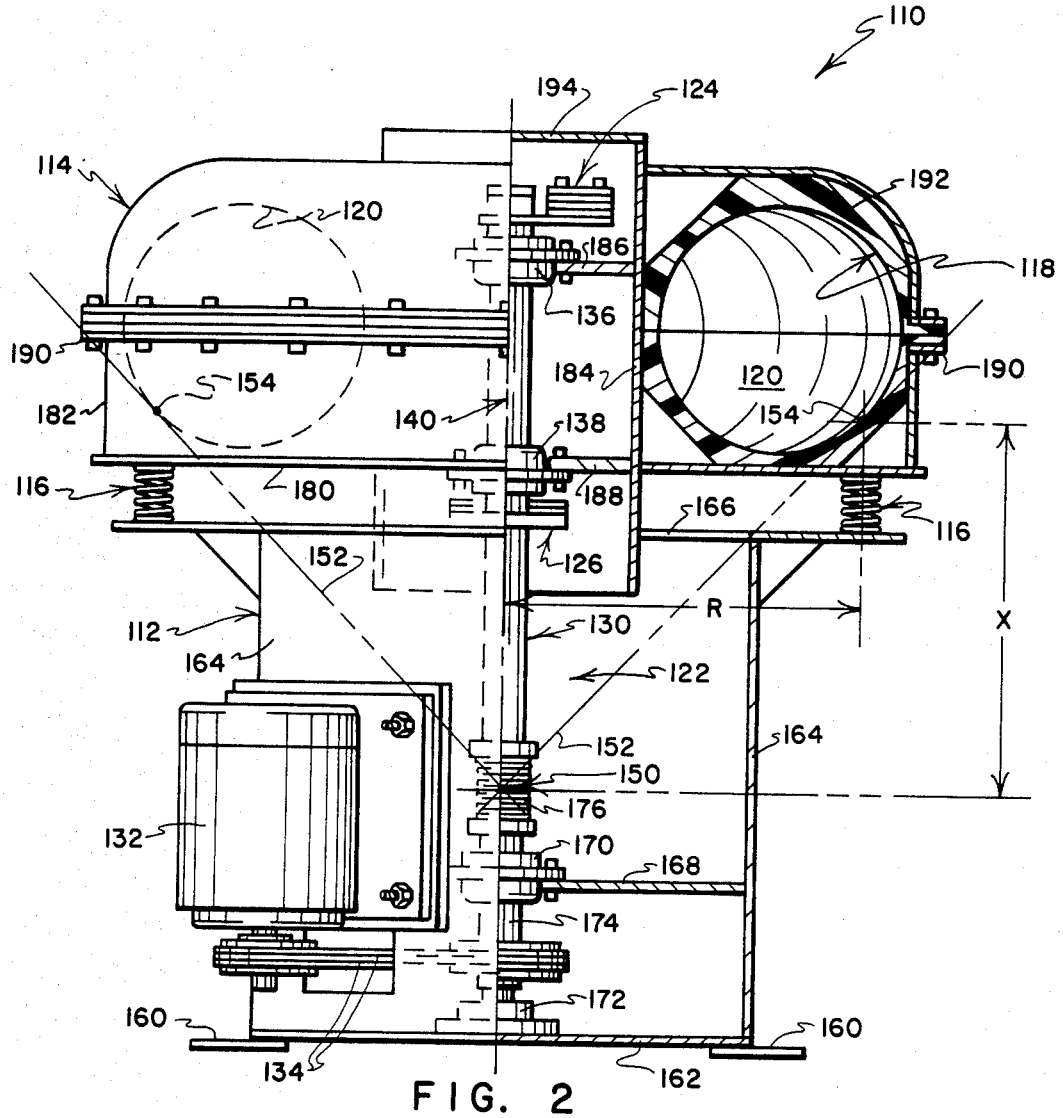
FIG. 2 is a side elevational view of an alternate embodiment of a bowl-type vibratory finishing machine incorporating features of the present invention, the view having portions broken away and shown in cross-section.

Referring to FIG. 2, a closed-top, bowl-type vibratory finishing machine incorporating features of the present invention is indicated generally by the numeral 110. The machine 110 includes a base structure 112 and a bowl structure 114. Resilient mounts in the form of compression coil springs 116 interconnect the structures 112, 114 to movably support the bowl 114 atop the base 112. A replaceable resilient liner assembly 118 forms part of the bowl structure 114 and defines an annular finishing chamber 120 for receiving a mixture of finishing media and workpieces to be finished.

A drive system for imparting vibratory movements to the bowl 114 is indicated generally by the numeral 122. The drive system 122 includes upper and lower eccentric weight assemblies 124, 126 supported at spaced locations along a rotatable eccentric drive shaft 130, a motor 132, and belts 134 which drivingly interconnect the motor 132 with an auxiliary drive shaft 174. Upper and lower bearing blocks 136, 138 journal the eccentric drive shaft 130 and are connected to the bowl 114 such that, when the eccentric drive shaft 130 is rotated, the vibrations it generates are transmitted to the bowl 114 to impart a finishing action to contents carried within the finishing chamber 120. Upper and lower bearing blocks 170, 172 journal the auxiliary drive shaft 174. A flexible coupling 176 drivingly interconnect the shafts 130, 174. The use of a flexible coupling positioned at the nodal point 150 of the machine 110 has the advantage of effecting an input of drive energy to the drive shaft 130 at the one and only location along the drive shaft 130 where vibrations and gyratory movements of the drive shaft 130 are minimal.

The coupling 176 should be selected to be of the type which will permit a limited degree of relative radial movement between the shafts 130, 174 so that the drive shaft 130 can gyrate to a limited degree about the nodal point 150 to permit proper operation of the machine 110. Couplings of this type are commercially available from a number of sources, examples being a coupling model number EE-30 sold by Koppers Company, Inc. of Baltimore, MD 21203, and a coupling model number SAGA-S-11 sold by Lovejoy, Inc. of Downers Grove, IL 60615.

The machine 110 has a "center axis," indicated generally by the numeral 140. The center axis 140 is an imaginary vertical line defined by the common axes of the drive shafts 130, 174 when the machine 110 is at rest. The center axis 140 extends substantially coaxially of the annular finishing chamber 120.

During operation of the machine 110, the bowl 114 gyrates in response to vibrations generated by rotation of the eccentric drive shaft 130. The bowl 114 prescribes a movement which generally centers about a node or nodal point 150. The nodal point 150 is located at the juncture of the center axis 140 and the tip of an imaginary inverted cone, opposed side surfaces of which are indicated in FIG. 2 by lines 152. The cone 152 has as its center axis the machine's center axis 140, i.e., the center axis 140 bisects the included angle between the lines 152. The cone 152 extends upwardly from the nodal point 150 to locations wherein it substantially tangentially intersects lower rounded locations 154 of the base of the finishing chamber 120. The locus of the locations 154 wherein the cone 152 tangentially intersects the finishing chamber 120 is an imaginary circle which extends in a substantially horizontal plane at a location spaced vertically above the nodal point 150 by a distance indicated by a dimension "X." The locations 154 which define this imaginary circle are spaced axially from the center axis 140 by a dimension "R."

The base structure 112 has a welded framework including feet 160, a bottom plate 162, side wall members 164, a top wall 166, and a bearing mounting plate 168. The bearing blocks 170, 172 are carried by the plates 168, 162, respectively, at locations along the center axis 140 below the nodal point 150. The flexible drive coupling 176 drivingly interconnects the shafts 130, 174 at the location of the nodal point 150 to impart drive energy from the motor 132 to the drive shaft 130, and to assist in restricting movements of the bowl 14 relative to the base 12 to movements generally about the nodal point 150. The coupling 176 has splined interior end regions (not shown), at least one of which slidably receives a splined end (not shown) formed on at least one of the shafts 130, 174. By this arrangement, the shafts 130, 174 may move axially relative to each other, whereby the coupling 176 in no way interferes with the operation of the springs 116 in supporting the bowl 114 for movement relative to the base 116, and the weight of the bowl 114 and/or its contents are prohibited from being transmitted to the shaft 174.

The bowl structure 114 has a welded framework including a bottom wall 180, a side wall 182, an upstanding center tube 184, and a pair of bearing mounting plates 186, 188. The bearing mounting plates 186, 188 carrying the bearings 136, 138, respectively. The bottom wall 180 is of annular configuration and is perimetrically welded to the side wall 182. The side wall 182 is of cylindrical configuration, extends upwardly from the bottom wall 180, and has a laterally extending rim 190 welded to its upper periphery. A finishing chamber cover 192 is bolted to the rim 190 to close the finishing chamber 120. The cover 192 is desirable in many instances where a large amplitude, extremely aggressive finishing action is to be employed to assure that contents are not inadvertently thrown from the chamber 20. Suitable charging and discharging openings (not shown) are provided to facilitate admitting and discharging contents to and from the chamber 120. The center tube 184 extends centrally through and is welded to the bottom wall 180. A cover plate 194 closes the upper end of the center tube 184.

A plurality of compression coil springs 116 are employed to movably support the bowl structure 114 atop the base structure 112. Each of the springs 116 has its opposed ends secured to the top wall 166 and to the bottom wall 180. The springs 116 perform optimally when they are located at equal radial distances from the center axis 140, as is indicated in FIG. 2 by the dimension "R." The springs 116 are positioned at uniformly spaced locations about the circumference of an imaginary circle having as its center a point on the center axis 140, and having at its radius the distance "R."

A characteristic of the machines 10, 110, 310 is that their drive shafts 30, 130, 330 are restrained within the vicinities of the nodal points 50, 150, 350 to assist in constraining movements of the bowls 14, 114, 314 to movements generally centering about the nodal points 50, 150, 350. As will be appreciated by those skilled in the art, the nodal points 50, 150, 350 do not remain totally rigidly fixed during operation of the machines 10, 110, 310, for some gyratory movement of the points 50, 150, 350 is needed to provide impulse force components which will cause the contents of the finishing chambers 20, 120, 320 to precess. The resilient mounts 67, 367 and the flexible coupling 176 provide for these types of gyratory movements of the nodal points within desired limits, while, at the same time, serving to constrain bowl structure movements to movements generally centering about the nodal points 50, 150, 350. By so constraining bowl movements, the sensitivities of the machines 10, 110, 310 to variations in finishing chamber loading is diminished and machine operation is improved. Stated in another way, a feature of the invention lies in the provision of a drive shaft restraint which assists in assuring that the bowl of a bowl machine is constrained to gyrate generally centrally about a selected nodal point while, at the same time, a limited degree of nodal point movement is permitted so that the desired type of efficient, aggressive finishing action is caused to result.

Figure 3:
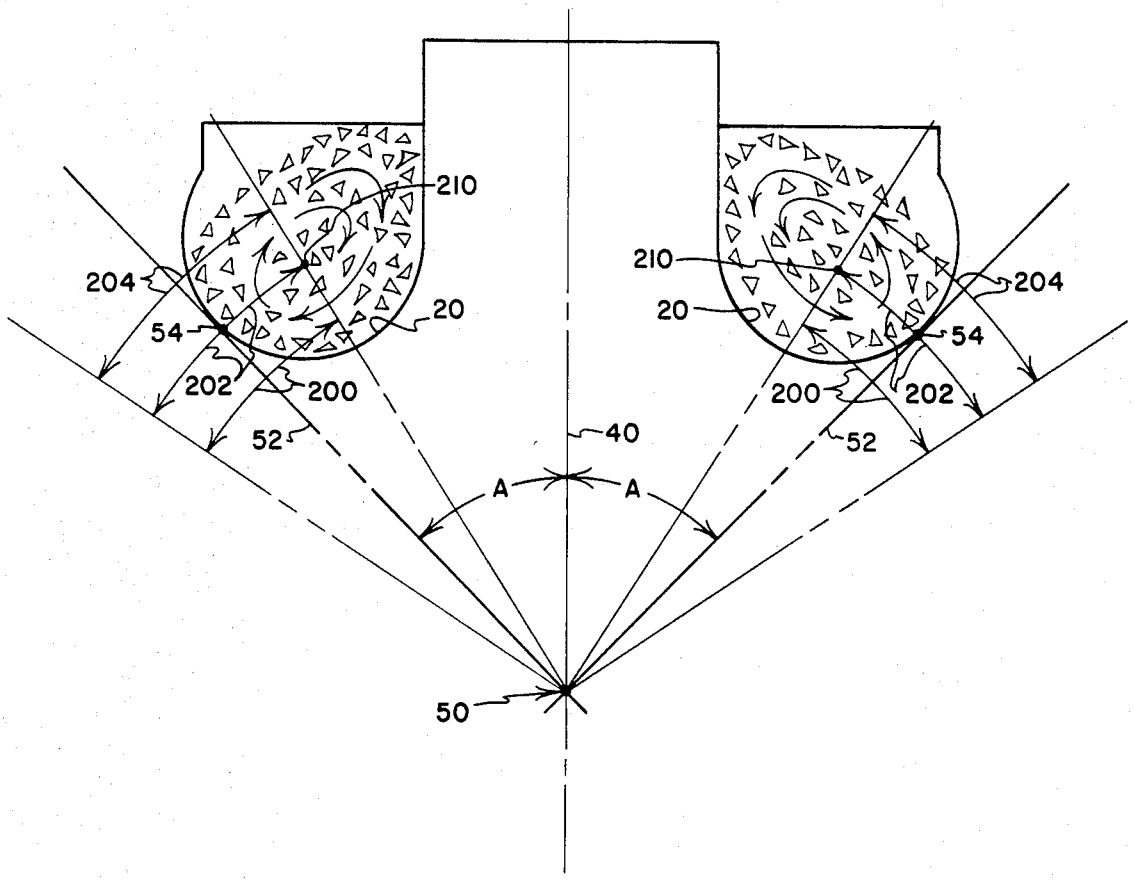
FIG. 3 is a schematic representation illustrating certain features of the novel arrangement of components employed in the machines of FIGS. 1 and 2, the representation being taken substantially as a sectional view indicated by a line 3—3 in FIG. 1; and, FIG. 4 is a side elevational view of still another alternate embodiment of bowl-type vibratory finishing machine incorporating features of the present invention, the view having portions broken away and shown in cross-section.

Another feature of the present invention lies in the selection of a nodal point location that will cause the movement of the bowl to impart a particularly effective, highly efficient type of finishing action to the contents of its finishing chamber. Referring to FIG. 3, the arrangement of machine components which, in accordance with features of the present invention, serves to simplify machine design and maximize the aggressive nature of the finishing action that is imparted to the contents of the bowls 14, 114, 314 of the machines 10, 110, 310 is illustrated schematically. For simplicity of discussion, FIG. 3 illustrates the type of open-top finishing chamber 20 employed in the machine 10, and the discussion will be presented in terms of the numerals used to describe the machine 10. As will be understood, however, the discussion which follows is equally applicable to corresponding components of, and to the operation of the machines 110, 310.

Referring to FIG. 3, the nodal point 50 is selected to lie along the center axis 40 at the tip of a cone indicated by the lines 52 which intersect the center axis 40. The cone indicated by the lines 52 intersects rounded lower portions 54 of the finishing chamber 20 only in a generally tangential fashion. The included angle "A" between each of the lines 52 and the center axis 40 is selected to lie within the range of about thirty five to fifty five degrees, with the optimum angle being about forty five degrees. By selecting the included angle "A" of the cone to fall with this range, the movements of the bowl 14 about the nodal point 50 cause the vibratory forces which are imparted to contents of the finishing chamber 20 to be directed substantially perpendicular to the surface of the cone, as indicated by arrows 200, 202, 204 which extend substantially perpendicular to the lines 52. By selecting the included angle "A" to be exactly the optimum angle of forty five degrees, the dimensions "R" and "A" are equalized, and this arrangement is found to perform particularly advantageously.

By locating the nodal point 50 where the tip of the cone 52 intersects with the center axis 40, the vibratory impulses which are transmitted to contents within the finishing chamber 20 by movements of the bowl 14 are imparted with maximum efficiency, in a manner not previously understood by those skilled in the art to be meaningful, much less important. If one considers a cross-section of the bowl 14 of the machine 10 taken along a vertical plane which includes the central axis 40 (which FIG. 3 represents as it is taken from a plane which includes the center axis 40 as indicated by a line 3–3 in FIG. 1), the contents of opposed sides of the finishing chamber 20 which are located within this cross-sectional plane will have centers of gravity which are indicated by the points 210 in FIG. 3. Impulse forces directed generally toward and away from the centers of gravity 210 as the bowl 14 vibrates about the nodal point 50 are indicated by the arrows 202 which originate where the lines 52 tangentially intersect the finishing chamber portions 54. By arranging the nodal point 50 such that the impulse forces directed at the centers of gravity 210 are inclined from the vertical at angles between about thirty five degrees and fifty five degrees (with the optimal angle being about forty five degrees) tests show that the aggressive nature of the resulting finishing action is maximized, therby permitting the bowl to be driven with maximum efficiency utilizing a relatively low-energy-input drive system.

The above-described arrangement causes impulse forces indicated by the arrow 202 to be imparted to contents of the finishing chamber 20 by chamber wall portions 54 which extend substantially perpendicular to the directions of the forces 202 to maximize the magnitude of these impulse forces in directions extending directly toward and away from the centers of gravity indicated by the points 210. Stated in another way, such vibratory movements as are imparted to the contents of the finishing chamber 20 at the points 54 (indicated in FIG. 3 by the arrows 202) are directed perpendicular to the lines 52, and extend toward centers of gravity of the contents as represented by the numerals 210. This impacting of the contents of the chamber 20 by liner wall portions 54 which extend substantially perpendicular to the directions of the impact forces (as represented by the arrows 202), and by impact forces directed generally toward the local centers of gravity (as represented by the points 210) takes maximum advantage of the vibratory movements of the bowl 14, whereby very large amplitude vibrations generating extraordinarily aggressive finishing actions can be imparted utilizing a relatively low-energy-input drive system.

As will be apparent from the foregoing description, the present invention provides a novel and improved, bowl-type vibratory finishing machine of lean and straightforward construction which is relatively insensitive to variations in bowl loading, which maximizes node point stability, and which takes maximum advantage of vibratory movements of the bowl to achieve a truly aggressive finishing action with minimal energy input.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. In a bowl-type vibratory finishing machine, including:

(a) a base structure, (b) a generally annular bowl structure having a central axis and defining a substantially annular finishing chamber having a rounded bottom adapted to receive finishing medial and workpieces to be finished;

(c) support means interposed between and movably supporting the bowl structure on the base structure, (d) drive means for vibrating the bowl structure relative to the base structure to impart a finishing action to contents within the finishing chamber by moving the bowl structure substantially about a nodal point located at a predetermined position along the central axis, the drive means including:

(i) a drive shaft extending with respect to said axis, said shaft being rotatable with respect to the bowl and base structure;

(ii) bearing means connected to the bowl structure and journaling the drive shaft such that rotation of the drive shaft will cause vibrations to be imparted to the bowl structure; and (iii) power-operated drive means carried by the base structure and connected to the drive shaft to rotate the drive shaft;

the improvement therein to achieve predeterminable maximized bowl-finishing action in any such bowl-type finishing machine by specific location of said nodal point comprising:

said nodal point on said central axis defining the apex of an imaginary conical surface generated therefrom, which surface tangentially intersects the rounded bottom surface portions of said bowl structure annular finishing chamber, wherein said conical surface forms an angle of between 35 degrees and 55 degrees with said central axis, and drive shaft restraint means disposed at said nodal point to constrain vibratory motion of said bowl structure to movements generally centering about said nodal point, said means including resilient elements cooperatively associated with said drive shaft about said axis at said nodal point to restrict gyratory motion thereof while permitting substantial gyratory motion of said bowl structure, and means providing a positive rotative drive connection between said power-operated drive means and said drive shaft while otherwise permitting said substantial relative gyratory movement to the drive shaft at the bowl structure.

2. The bowl-type vibratory finishing machine of claim 1 wherein the drive shaft restraint means includes spherical bearing means connected to the drive shaft within the vicinity of the nodal point.

3. The bowl-type vibratory finishing machine of claim 2 wherein the drive shaft restraint means additionally includes flexible support means connecting the spherical bearing means to the base structure for permitting very limited movement of the spherical bearing relative to the nodal point.

4. The bowl-type vibratory finishing machine of claim 3 wherein the flexible support means includes elastomeric mounting means having first portions connected to the base structure, and second portions connected to the spherical bearing means.

5. The bowl-type vibratory finishing machine of claim 4 wherein the elastomeric mounting means includes a plurality of elastomeric mounts, each having one of said first portions and one of said second portions located near opposed ends thereof, and each being arranged with its first and second portions defining an axis which extends substantially parallel to the central axis.

6. The bowl-type vibratory finishing machine of claim 5 wherein the elastomeric mounts are positioned about the central axis at substantially equally spaced intervals along the circumference of a circle having a point on the central axis as its center.

7. The bowl-type vibratory finishing machine of claim 6 wherein:

(a) the base structure includes a mounting plate;

(b) the spherical bearing means includes a spherical bearing carried by a bearing support plate; and, (c) the first and second portions of each of the elastomeric mounts are connected, respectively, to the mounting plate and the bearing support plate.

8. The bowl-type vibratory finishing machine of claim 2 wherein the spherical bearing means slidably receives the eccentric drive shaft so as to minimize interference of the spherical bearing with the operation of the support means in movably supporting the bowl structure on the base structure.

9. The bowl-type vibratory finishing machine of claim 1 wherein:

(a) the drive shaft restraint means includes a second shaft journaled by the base structure for rotation about the central axis; and, (b) the power-operated drive means is drivingly connected to the second shaft and via a flexible coupling to the eccentrically weighted drive shaft, with the flexible coupling being located in proximity to the nodal point.

10. The bowl-type vibratory finishing machine of claim 9 wherein:

(a) the second shaft is connected to the base structure by a pair of bearings; and, (b) the flexible coupling slidably receives at least one of the eccentrically weighted drive shaft and the second shaft so as to minimize interference of the drive shaft restraint means with the operation of the support means in movably supporting the bowl structure on the base structure.

11. The bowl-type vibratory finishing machine of claim 1 wherein the support means includes a plurality of resilient supports, each having one portion connected to the bowl structure and another portion connected to the base structure, the one and another portions defining an axis for each mount, said mount axes extending substantially vertically and being substantially equally spaced about the circumference of an imaginary circle which has as its center a selected point on the center axis of the machine, and which has a radius equal to the radius "R."

12. The bowl-type vibratory finishing machine of claim 11 wherein the resilient supports include compression coil springs each having one end region connected to the bowl structure and another end region connected to the base structure.

13. The bowl-type vibratory finishing machine of claim 1, wherein:

(a) the eccentrically weighted drive shaft includes a shaft structure extending along the center axis, and upper and lower eccentric weight assemblies connected at vertically spaced locations to the shaft structure; and, (b) the bearing means includes a pair of bearing structures connected to the bowl structure and journaling the drive shaft at vertically spaced positions along the drive shaft.

14. The bowl-type vibratory finishing machine of claim 1 wherein the said angle is approximately 45 degrees.

15. The bowl-type vibratory finishing machine of claim 1 wherein such contents of the finishing chamber portions as lie within said plane have centers of gravity located on opposite sides of the center axis, and the nodal point is located such that vibratory movements of the bowl structure relative to the base structure about the nodal point impart impulses forces directed toward and away from said centers of gravity at angles "B" which lie within the range of about 35 degrees to 55 degrees from the vertical.

16. The bowl-type vibratory finishing machine of claim 15 wherein the angles "B" are approximately 45 degrees.

17. A bowl-type vibratory finishing machine comprising:

(a) a base structure;

(b) a generally annular bowl structure having a substantially vertical central axis and defining a substantially horizontally-extending annular finishing chamber adapted to receive finishing media and workpieces to be finished;

(c) support means interposed between and movably supporting the bowl structure on the base structure;

(d) drive means for vibrating the bowl structure relative to the base structure to impart a finishing action to contents within the finishing chamber by moving the bowl structure substantially about a nodal point located at a predetermined position along the central axis, the drive means including:

(i) an eccentric drive shaft extending along the center axis and being rotatable with respect to the bowl and base structures;

(ii) bearing means connected to the bowl structure and journaling the drive shaft such that rotation of the eccentric drive shaft will cause vibrations to be imparted to the bowl structure;

(iii) power-operating drive means carried by the base structure and connected to the drive shaft to rotate the drive shaft;

(e) drive shaft restraint means connected to the base structure for restraining movement of the drive shaft within the vicinity of the nodal point to assist in confining movement of the bowl structure to movement generally centering about the nodal point, said means including resilient elements cooperative associated with said drive shaft about said axis at said nodal point to restrict gyratory motion of said nodal point while permiting substantial gyratory motion of said bowl structure; and, (f) means forming the configuration of said base structure, said bowl structure, said support means and said restraint means to locate the nodal point at a position along the central axis beneath the finishing chamber at a location wherein a pair of imaginary lines which extend in an imaginary plane that includes the center axis intersect the center axis, the imaginary lines being oriented such that they intercept lower outer edge portions of the finishing chamber located on opposite sides of the center axis, and such that each of the imaginary lines forms a substantially equal included angle of about 45 degrees, plus or minus about 10 degrees, with the center axis.

18. The bowl-type vibratory finishing machine of claim 17 wherein the drive shaft restraint means includes spherical bearing means connected to the drive shaft within the vicinity of the nodal point.

19. The bowl-type vibratory finishing machine of claim 18 wherein the drive shaft restraint means additionally includes flexible support means connecting the spherical bearing means to the base structure for permitting only limited movement of the spherical bearing relative to the nodal point.

20. The bowl-type vibratory finishing machine of claim 19 wherein the flexible support means includes elastomeric mounting means having first portions connected to the base structure, and second portions connected to the spherical bearing means.

21. The bowl-type vibratory finishing machine of claim 20 wherein the elastomeric mounting means includes a plurality of elastomeric mounts, each having first and second portions located near opposed ends thereof, and each being arranged with its first and second portions defining an axis which extends substantially parallel to the central axis.

22. The bowl-type vibratory finishing machine of claim 21 wherein the elastomeric mounts are positioned about the central axis at substantially equally spaced intervals along the circumference of a circle having a point on the central axis as its center.

23. The bowl-type vibratory finishing machine of claim 21 wherein:

(a) the base structure includes a substantially horizontally-extending mounting plate;

(b) the spherical bearing means includes a spherical bearing carried by a substantially horizontally-extending bearing support plate; and, (c) the first and second portions of each of the elastomeric mounts are connected, respectively, to the mounting plate and the bearing support plate.

24. The bowl-type vibratory finishing machine of claim 18 wherein the spherical bearing means slidably receives the eccentric drive shaft so as to minimize interference of the spherical bearing with the operation of the support means in movably supporting the bowl structure on the base structure.

25. The bowl-type vibratory finishing machine of claim 17 wherein:

(a) the drive shaft restraint means includes a second shaft journaled by the base structure for rotation about the central axis; and, (b) the power-operated drive means is drivingly connected to the second shaft and via a flexible coupling to the eccentric drive shaft, with the flexible coupling being located in proximity to the nodal point.

26. The bowl-type vibratory finishing machine of claim 25 wherein:

(a) the second shaft is connected to the base structure by a pair of bearings; and, (b) the flexible coupling slidably receives at least one of the eccentric drive shafts and the second shaft so as to minimize interference of the drive shaft restraint means with the operation of the support means in movably supporting the bowl structure on the base structure.

27. The bowl-type vibratory finishing machine of claim 17 wherein the support means includes a plurality of resilient supports, each having one portion connected to the bowl structure and another portion connected to the base structure, the one and another portions defining an axis for each mount, said mount axes extending substantially vertically and being substantially equally spaced about the circumference of an imaginary circle which has as its center the center axis of the machine, and which has a radius equal to the distance "R."

28. The bowl-type vibratory finishing machine of claim 27 wherein the resilient supports include compression coil springs each having one end region connected to the bowl structure and another end region connected to the base structure.

29. The bowl-type vibratory finishing machine of claim 17, wherein:

(a) the eccentric drive shaft includes a shaft structure extending along the center axis, and upper and lower eccentric weight assemblies connected at vertically spaced locations to the shaft structure; and, (b) the bearing means includes a pair of bearing structures connected to the bowl structure and journaling the drive shaft at vertically spaced positions along the drive shaft.

* * * * *